US005530973A

United States Patent [19]

Dodge

[11] Patent Number: 5,530,973

[45] Date of Patent: Jul. 2, 1996

[54] CAMP SINK WITH HEAT SOURCE

[76] Inventor: James L. Dodge, 375 "A" Owosso Dr., Eugene, Oreg. 97404

[21] Appl. No.: 370,524

[22] Filed: Jan. 9, 1995

[51] Int. Cl.[6] ..... A47K 1/05

[52] U.S. Cl. ..... 4/643; 4/654; 4/619

[58] Field of Search ..... 4/625, 638, 602, 4/603, 619, 545, 546, 450–457, 588, 630, 643, 654; 220/565, 666

[56] References Cited

U.S. PATENT DOCUMENTS

| | | | |
|---|---|---|---|
| 225,880 | 3/1880 | Skelley . | |
| 743,447 | 10/1903 | Cassell . | |
| 1,389,050 | 8/1921 | Jarrett | 4/545 |
| 2,213,359 | 9/1940 | Bessett . | |
| 2,594,938 | 10/1949 | Leavitt . | |
| 2,672,628 | 3/1954 | Spanel | 4/588 X |
| 3,061,840 | 11/1962 | Presseisen | 4/456 X |
| 3,108,170 | 10/1963 | Murphy | 4/545 |
| 3,409,917 | 11/1968 | Howard | 4/588 |

FOREIGN PATENT DOCUMENTS

| | | | |
|---|---|---|---|
| 0171772 | 12/1951 | Austria | 4/603 |

*Primary Examiner*—Charles E. Phillips
*Attorney, Agent, or Firm*—James D. Givnan, Jr.

[57] ABSTRACT

A portable sink for use out-of-doors has inflatable side walls with a sink bottom wall having a holder thereon into which may be placed a heat packet providing a unitary heat source for heating sink contents. The holder may be of a closed cell synthetic material to lessen heat loss.

6 Claims, 1 Drawing Sheet

CAMP SINK WITH HEAT SOURCE

BACKGROUND OF THE INVENTION

The present invention concerns a collapsible sink for use out-of-doors by campers, hikers, hunters, etc., with provision for heating sink contents.

The task of washing dishes at a campsite or other outdoor site typically requires the heating of a sizeable container of water over a fire. The same is true for water used for washing and shaving. Accordingly considerable time and effort is spent in such heating. Further, conventional washing receptacles, such as large dishpans, are not highly portable by reason of taking up space and adding weight to the gear required for an outdoor venture.

U.S. Pat. No. 225,880 shows a wash basin with a receptacle below it for soap storage. U.S. Pat. No. 743,447 shows a dishpan in which a fire-pot may be positioned. U.S. Pat. No. 2,213,359 discloses a partitioned sink with gas burners for heating sink contents. U.S. Pat. No. 2,594,938 discloses a camp or outdoor sink with an elevated water supply tank heated by a gas burner.

SUMMARY OF THE PRESENT INVENTION

The present invention is embodied in an open container such as a sink in which a quantity of water is stored and heated by a self-contained heat source in place on a bottom wall of the container.

The present sink structure includes collapsible side walls and a bottom wall affixed thereto to confine a sizeable quantity of water. A holder in place on the bottom wall serves to receive a unitary heat source such as a sealed heat packet such as one containing sodium acetate and water and in which an exothermic reaction may be triggered when desired. The holder has insulative characteristics to ensure the heat released is imparted to sink contents. To render the present container highly portable the side walls of same are preferably collapsible which, in view of the bottom wall being pliant, permits the container to be rolled or folded for storage. Preferably the side walls are of an inflatable nature for compact storage purposes.

A suitable holder for the heat source is of a closed cell elastomer to diminish heat loss to ambient air or to a supporting surface on which the present container rests when in use.

Important objectives of the present heatable container include the provision of a container which may serve as a sink with provision for heating the container contents using a replaceable, unitary heat source to avoid the need for a fire; the provision of a container of pliant construction to permit collapsing and storing of same in a small space to render the container portable in a back pack or the like; the provision of a container for use out-of-doors to provide a sizeable quantity of heated water for whatever cleaning problems are at hand; the provision of a container for heated water and having a heat source, such as a heat packet with an exothermic reaction, removably confined in a holder having insulative features.

DETAILED DESCRIPTION OF THE INVENTION

Figure 1:
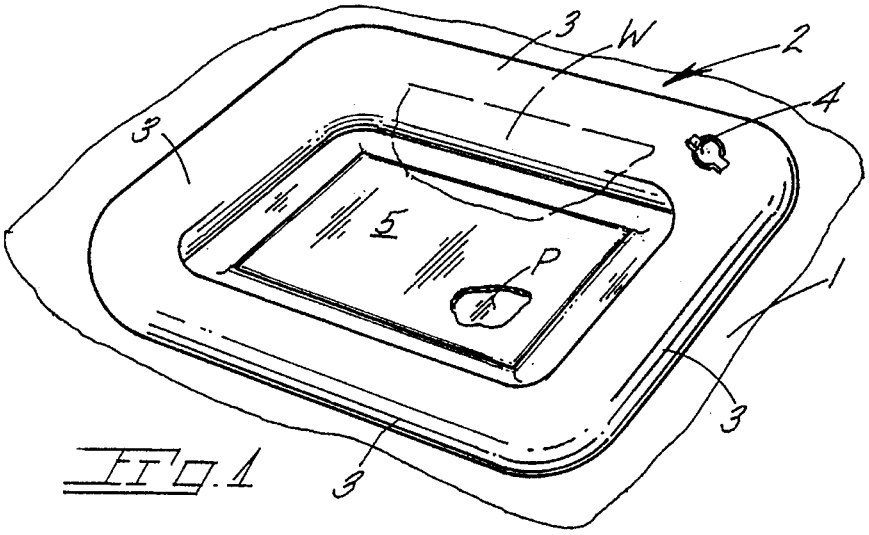
FIG. 1 is a perspective view of the present container on a supporting surface.

With continuing attention to the drawings wherein applied reference numerals indicate parts hereinafter similarly identified, the reference numeral 1 indicates a support surface on which the present invention may be placed, as for example, a table top.

With attention now to the present invention, the reference numeral 2 indicates generally side wall structure of the container having wall members 3 of pliant material such as vinyl. The side wall structure is preferably continuous so as to be inflatable with each member 3 having an inner surface 3A. An air valve is at 4.

Figure 3:
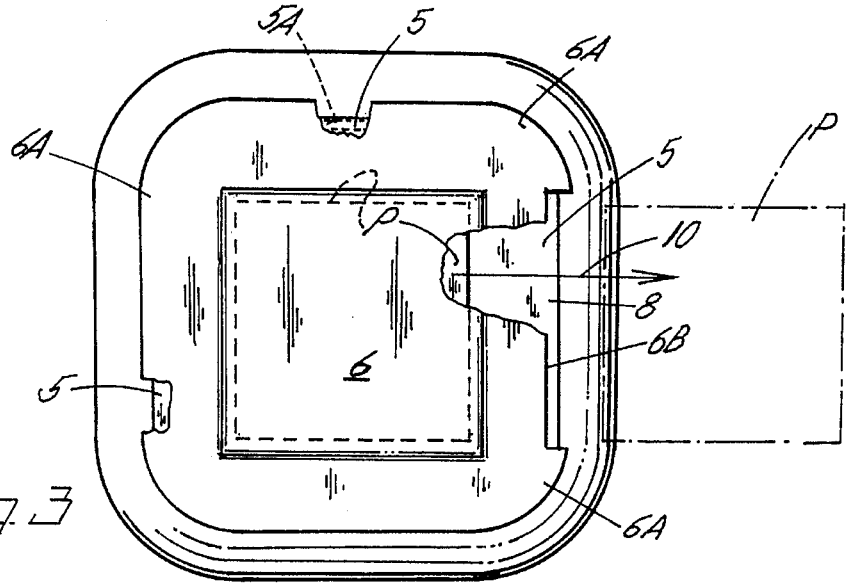
FIG. 3 is a bottom plan view of the present container.

A container bottom wall is at 5 and may be of sheet material such as vinyl with its perimeter joined as by fusing or an adhesive at 5A (FIG. 3) to the lowermost surface portions of the wall members. Accordingly a receptacle is formed for a quantity of water W which may be at a level proximate the uppermost surface portion of member 3. Inflatable sinks of the above type are in the marketplace.

Indicated at P is a heat packet providing a heat source of the type having an exothermic action. One suitable heat packet is that manufactured by PRISM TECHNOLOGIES and sold under the trademark ZAP PAC. Such a packet contains sodium acetate and water and is triggered or actuated sonically by flexing of a flexible disk in the packet. When in place, the packet is in surfacial contact with bottom wall 5 by means of a holder 6 which, along with the bottom wall, defines a space 7 to receive the packet. To minimize heat loss from the packet and sink to surface 1 holder 6 is preferably of an insulative nature such as a closed cell polyethylene which is of a pliable nature and which fully underlies the bottom wall. Marginal areas 6A of the holder are preferably secured to side wall structure 2 of the sink by suitable means, e.g., adhesively, fusing by an electric weld, etc.,. An opening at 8 permits packet insertion and removal per arrow 10.

Figure 2:
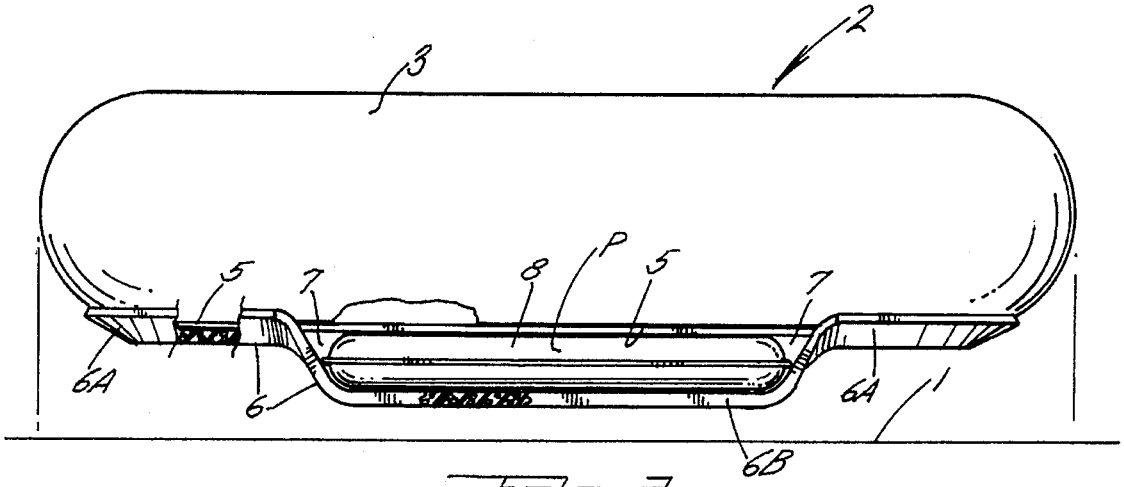
FIG. 2 is an end elevational view of the container taken from the right hand side of FIG. 1 and shown elevated from a supporting surface for illustrative purposes only.

In use, the sink may be inflated by the user blowing through valve 4 to cause each of the side walls to assume a circular cross section shown typically in FIG. 2. With the sink inflated and momentarily elevated from supporting surface 1, the heat packet P is inserted through opening 8 defined by sink bottom wall 5 and a free edge 6B of holder 6. Subsequent sink placement on surface 1 results in slight upward displacement of sink bottom wall 5 as illustrated in FIG. 1. Heat released by packet P maintains sink water W at a desired elevated temperature for whatever washing task is at hand. A heat packet measuring eight inches square is insertable through elongate opening 8 and is capable of maintaining the temperature of the contents of the present sink measuring eighteen inches square for an adequate period of time.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. An open container for placement on a surface to receive a quantity of water and including, side walls, a bottom wall of pliant material secured to said side walls for support by said surface, and a holder in place subjacent the bottom wall and defining with said bottom wall an open space into which a heat source may be inserted in a removable manner for heating the water, said holder being of closed cell synethetic sheet material for insulative purposes.

2. The container claimed in claim 1 wherein said side walls are of pliant material.

3. The container claimed in claim 2 wherein said side walls are of inflatable construction.

4. A receptacle for liquids comprising, side walls of inflatable construction, a bottom wall secured to said side walls, and a holder located subjacent said bottom wall and defining a space into which a heat source may be inserted in a removable manner for heating the contents of the receptacle, said holder and said bottom wall defining an opening for insertion of the heat source, said holder being of insulative closed cell material and fully underlying said bottom wall and secured to said side walls.

5. The receptacle claimed in claim 4 wherein said bottom wall and said holder are of a pliant nature.

6. An open container for placement on a surface to receive a quantity of water and including, side walls, a bottom wall of pliant material secured to said side walls for support by said surface, and a holder in place subjacent the bottom wall and defining with said bottom wall an open space into which a heat source may be inserted in removable manner for heating the water, said holder being of cellular insulative material and supported by said side walls, said holder and said bottom wall defining an elongate opening for insertion of said heat source.

* * * * *